United States Patent [19]

Kelsey

[11] Patent Number: 4,898,666

[45] Date of Patent: Feb. 6, 1990

[54] ROTATING CENTRIFUGAL JIG WITH PULSATOR

[75] Inventor: Christopher G. Kelsey, Sydney, Australia

[73] Assignee: Lowan (Management) Pty. Limited, East Glenelg, Australia

[21] Appl. No.: 939,520

[22] PCT Filed: Jan. 24, 1986

[86] PCT No.: PCT/AU86/00016

§ 371 Date: Sep. 22, 1986

§ 102(e) Date: Sep. 22, 1986

[87] PCT Pub. No.: WO86/04269

PCT Pub. Date: Jul. 31, 1986

[30] Foreign Application Priority Data

Jan. 25, 1985 [AU] Australia ..... PH9037
Apr. 12, 1985 [AU] Australia ..... PG0122

[51] Int. Cl.[4] ..... B03B 5/12

[52] U.S. Cl. ..... 209/425; 209/44; 209/494

[58] Field of Search ..... 209/155, 208, 211, 426, 209/425, 490, 494, 503, 504, 44; 210/512.3, 523

[56] References Cited

U.S. PATENT DOCUMENTS

| | | | |
|---|---|---|---|
| 2,312,522 | 3/1943 | Chisholm | 209/425 |
| 2,631,728 | 3/1953 | Popp | 209/211 |
| 3,703,237 | 11/1972 | Cohen-Alloro et al. | 209/426 |
| 4,056,464 | 11/1977 | Cross | 209/425 |
| 4,071,440 | 1/1978 | Jedo et al. | 209/44 |
| 4,279,741 | 7/1981 | Campbell | 209/44 |

FOREIGN PATENT DOCUMENTS

| | | | |
|---|---|---|---|
| 0583820 | 12/1977 | U.S.S.R. | 209/490 |

*Primary Examiner*—Cherry, Johnny D.
*Assistant Examiner*—Donald T. Hajec
*Attorney, Agent, or Firm*—Beveridge, DeGrandi & Weilacher

[57] ABSTRACT

A centrifugal jig of the type in which a feed slurry is introduced into a container rotating about a vertical axis in a region radially bounded by a screen. The screen is preferably substantially parabolic in shape. Ragging is provided on the screen's inner surface and water is provided in the hutch region on the opposite side of the screen. The water in the hutch region is pulsed repetitiously to dilate the ragging and pulsion of the hutch water is achieved at an interface such as a diaphragm interface or an air/water interface. The interface is positioned substantially wholly beyond the projected free surface of the feed material.

15 Claims, 8 Drawing Sheets

ROTATING CENTRIFUGAL JIG WITH PULSATOR

TECHNICAL FIELD

This invention relates to jigs employed in mineral separation, in which minerals of different specific gravity are separated by stratification in a mass which is repetitively dilated and compressed.

BACKGROUND ART

Conventional jigs operate by means of gravity, and may comprise a sieve which is vibrated within a body of water, or a fixed sieve immersed in water which is pulsated. Separation of particles takes place in the jig bed according to specific gravity, the bed consisting of a layer of coarse heavy particles or raging. Particles with high specific gravity penetrate the ragging while particles of low specific gravity are carried away from the ragging by cross flow of water.

In Cross U.S. Pat. No. 4,056,464 there is described a jig in which slurry is introduced on to a rotor on which is held captive, ragging supported on a woven mesh screen, the rotor and screen being of frusto-conical shape. The rotor and screen rotate within a stationary container of water which is pulsed to provide a jigging action supplemented by centrifugal force.

Campbell U.S. Pat. No. 4,279,741 is likewise directed to a centrifugal jig, Campbell employing a cylindrical screen and in one embodiment a rotating chamber.

DISCLOSURE OF INVENTION

The present invention also provides a jig in which centrifugal action is employed in the concentration of the particles in the jigging cycle.

In one form the present invention resides in a centrifugal jig comprising a container mounted for rotation about its longitudinal axis, the container comprising an axial region and a peripheral region with ragging separating the two regions. The centrifugal jig has means for rotating the container, means for introducing feed material to the axial region, means for supplying fluid to the peripheral region, and means for pulsating the fluid in the peripheral region while the container rotates. The pulsating means includes interface means communicating with the peripheral region. The interface means is positioned substantially wholly outside the volume defined by the free surface of the feed material and the projection of that free surface to its intersection with the longitudinal axis.

The machine of the present invention embodies other advances over the machines of Cross and Campbell, as will be found in the following description of several embodiments of the invention.

Figure 1:
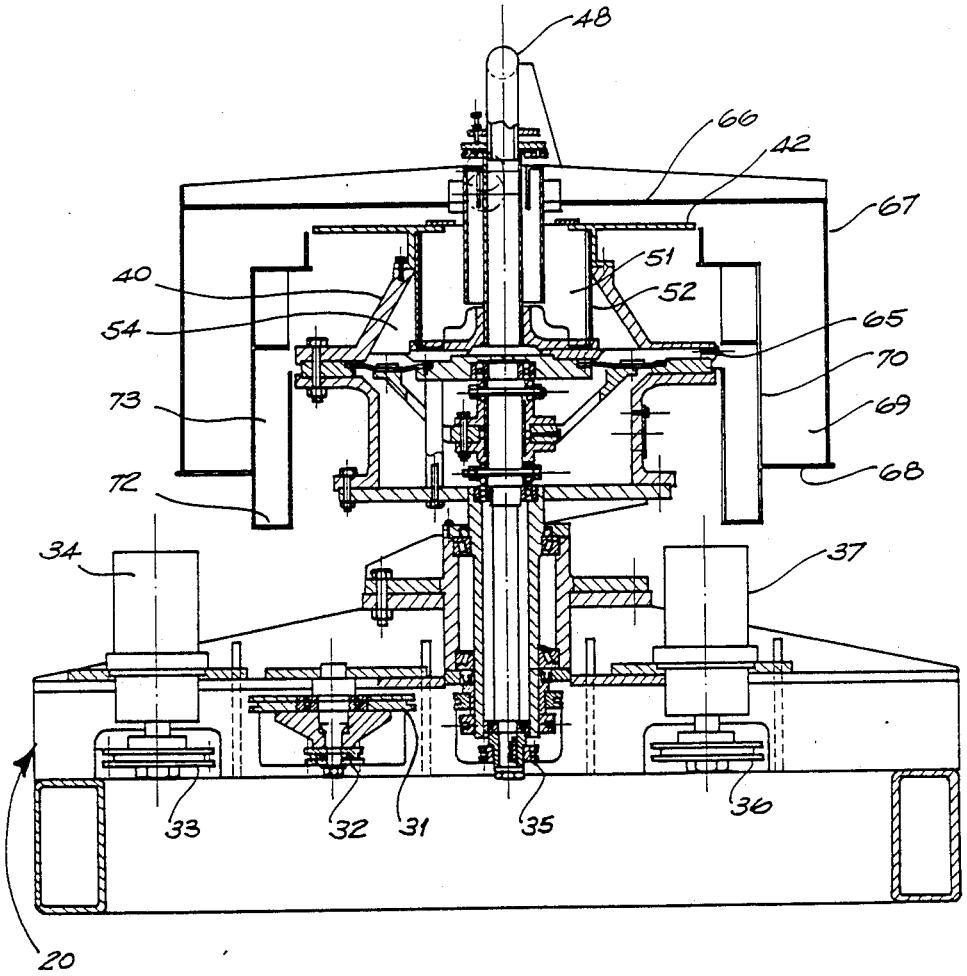
FIG. 1 is a sectional elevation of a first embodiment of the present invention.

The apparatus illustrated in FIGS. 1 and 2 comprises a base which houses driving arrangements which will be described below, and which supports a bearing housing 21. Mounted within the bearing housing 21 by means of tapered roller bearings 22 is an outer drive shaft 23 which carries on its upper end a circular mounting flange 24.

A support housing 25 is mounted on the flange 24 by means of pillars 26. Mounted within the outer drive shaft 23 by means of bearings **26*a* and 27, and with its upper end located in a bearing 28 in the support housing 25, is a cam drive shaft 29**.

The outer drive shaft 23 is driven by chains (not shown) between a sprocket 30 on the outer drive shaft and a sprocket 31 on an idler shaft 32, the sprocket 31 being in turn driven by a chain drive between the sprocket 32 and a sprocket 33 associated with a drive motor 34. The cam driving shaft 29 is driven by a chain drive between a sprocket 35 at the lower end of the cam drive shaft and sprocket 36 driven by a second drive motor 37.

Figure 3:
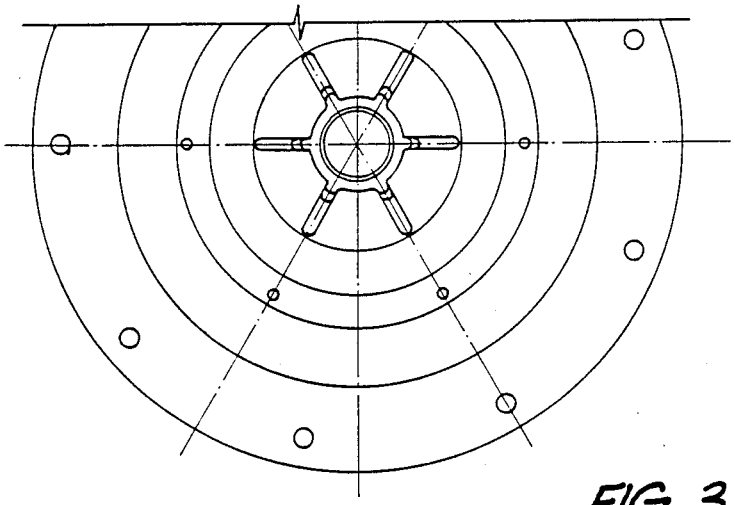
FIG. 3 is an incomplete plan view of the body member of the apparatus of FIG. 1.
Figure 4:
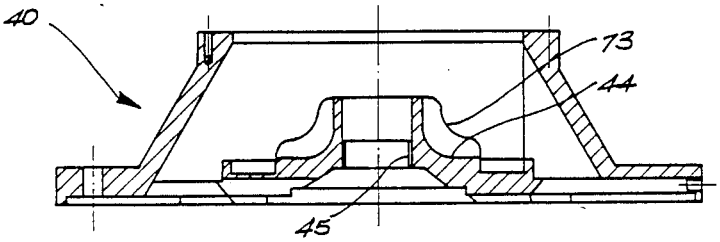
FIG. 4 is a lateral cross-section of the body member.
Figure 5:
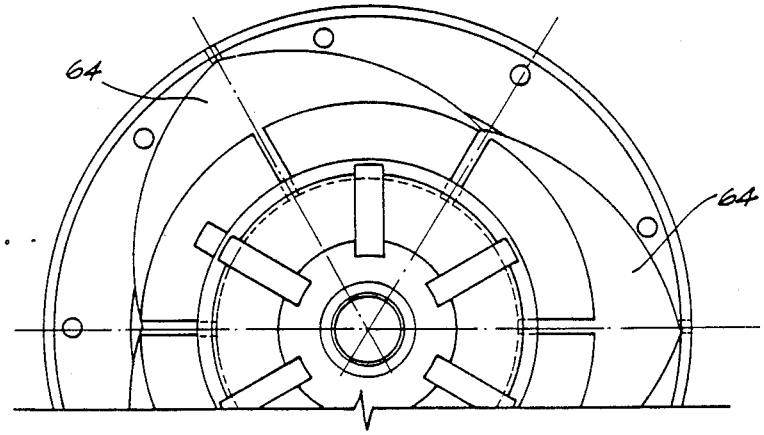
FIG. 5 is an incomplete bottom plan view of the body member.

Also mounted on the flange 24 is a support and cover 38 on which is mounted a ring 39 which in turn supports a body member 40 shown in more detail in FIGS. 3, 4, and 5.

The body 40 supports a top cover 41 which provides a peripheral flange 42 and a dam portion 43, the function of which will be described below.

Mounted within a central boss 44 by engagement with a threaded portion 45 is a water supply pipe 46. As the pipe 46 will rotate with the body member 40, a rotating seal assembly 47 is employed at the connection between the supply pipe 46 and a water inlet pipe 48.

Surrounding the water supply pipe 46 and communicating with a slurry inlet pipe 49 is a slurry supply jacket 50 which is open at its lower end to communicate with the region 51 between the axis of the apparatus and a mesh screen 52. This screen may comprise a wedge wire screen of conventional construction, of a gauge to suit the application for which the equipment is intended, typically in the region of passing 300 micron. The screen is located at its upper end by the top cover 41 and at its lower end is mounted within a groove provided in the body member 40 at 53. The characteristics of the screen 52 are further described below.

Figure 2:
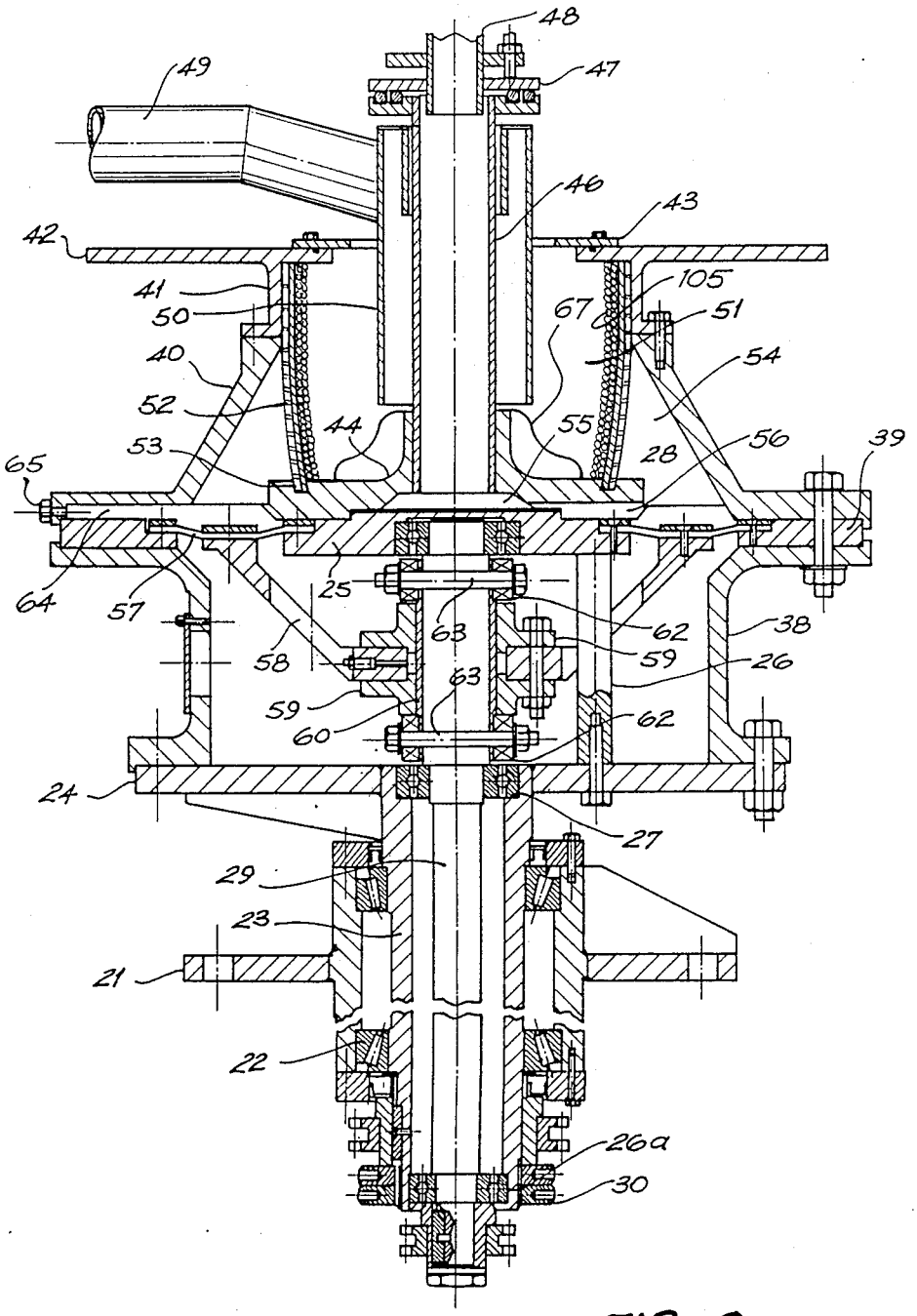
FIG. 2 is a sectional elevation of part of the apparatus of FIG. 1.

The parabolic shape of this screen is shown only in FIG. 2. In the other figures, the screen 52 is depicted schematically.

The water supply pipe 46 communicates with the region 54 between the screen 52 and frusto-conical side wall of the body member 40, via a central well 55 and radial slots 56 provided in the central portion 44 of the body member 40.

The region 54 is closed from below by an annular diaphragm 57 of rubber, the outer edge of which is fixed to the inner edge of the ring 39, the inner edge of the diaphragm 57 being supported on the outer edge of the support housing 25.

Figure 6:
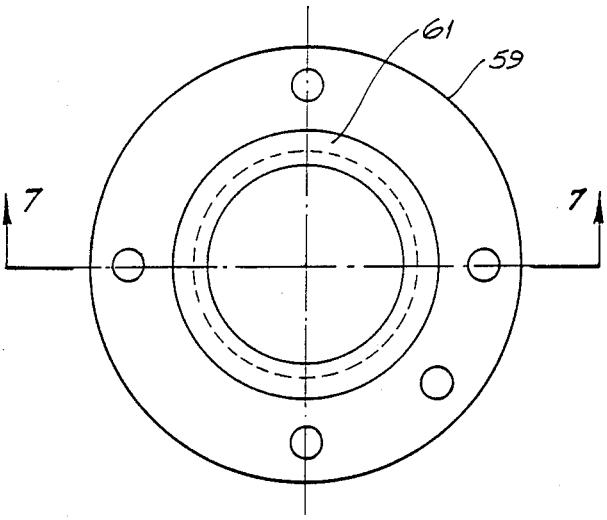
FIG. 6 is a plan view of a cam of said apparatus.
Figure 8:
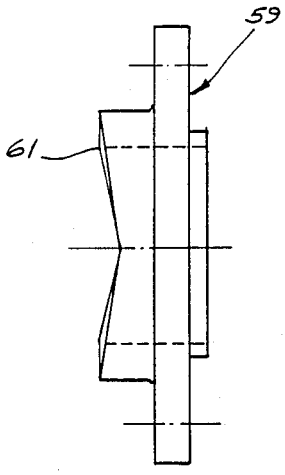
FIG. 8 is a side elevation of the cam.
Figure 7:
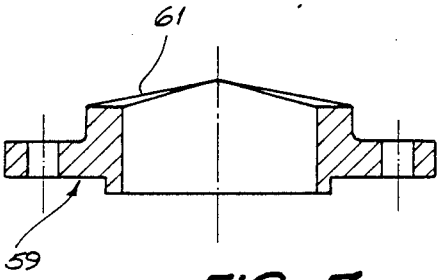
FIG. 7 is a section taken on the line 7—7 of FIG. 6.

Fixed to the central portion of the diaphragm 57 is the upper end of a frusto-conical pulsator body 58, which surrounds the cam driving shaft 29. The lower end of the pulsator body 58 is mounted by clamping between a pair of cams 59 shown in more detail in FIGS. 6, 7 and 8. The cams 59 are mounted on a centred bronze bush 60 on the shaft 29, and their contoured cam surfaces 61 ride against roller bearings 62 fixed to the shaft 29 by means of bolts 63. The contours of the cam surfaces 61 are such that as the shaft 29 rotates and consequently the roller bearings 62 rotate against the cams 59, the cams will reciprocate in the axial direction of the shaft 29, and it will be observed that this reciprocation will be transferred to the diaphragm 57.

As will be seen particularly in FIG. 5, the base of the body member 40 is provided with 3 lobe-shaped cavities 64 leading to outlet nozzles 65 at the periphery of the body member 40. The side walls of the cavities 64 leading to the outlet nozzles 65 are so contoured as to present at any point, a constant angle to a radius from the axis of rotation of the apparatus, in the case of the illustrated embodiment, 30 degrees. The purpose of this contour will be described below.

As shown in FIG. 1, the upper part of the apparatus is surrounded by a launder assembly comprising a top cover 66, outer wall 67 and a base wall 68 defining an outlet region 69, and peripheral and lower walls 70, 71 and 72 defining a second outlet chamber 73. It will be observed that the chamber 69 communicates with the region above the flange 42, while the chamber 73 is positioned to receive material from the nozzles 65. The launder assembly is of course mounted on the base 20, by means not shown in the drawings.

The operation of the illustrated apparatus is as follows:

With the outer drive shaft and the components carried by it including the support and cover 38, the body member 40, the top cover 41 and the flange 42 rotating at a speed determined by the drive motor 34, water is supplied from the feed pipe 48 through the supply pipe 46 and via the well 55 and slots 56, to the region 54. Simultaneously, the jig feed in the form of slurry of prepared feed material is fed to the jig via the slurry supply pipe 49 and the jacket 50. Slurry entering the region 51 from the lower end of the jacket 50 will of course be thrown outwardly by the rotation of the body member 40, assisted by the ribs 67 of the body member boss 44. Meanwhile supply water will have filled the region 54.

Prior to the introduction of the slurry and feed water, ragging of a size and density chosen to suit the feed material and the fractions to be separated, is introduced into the region 51. Suitable materials for ragging include run-of-mill garnet, balls of aluminium/bronze alloy, and lead glass balls.

Rotation of the machine will place the ragging against the screen 52, and as the feed material enters the region 51 and is thrown outwardly, it will move upwardly against the ragging material and the screen. The ragging will tend to be compacted against the screen 52 by centrifugal action, analogously with the compaction of the ragging of a conventional pulsed water gravity jig. As the diaphragm 57 moves upwardly due to the action of the cams 59 with rotation of the cam drive shaft 29, the water in the chamber 54 will be pressurised, and this pulsion will produce dilation of the ragging, again in the manner of a conventional gravity jig, freeing the heavier particles of the feed for outward movement relative to the lighter particles, due to the rotation of the machine. On the return or downward stroke of the diaphragm 57, the pressure in the chamber 54 will be reduced and the ragging material will again become closely compacted, in readiness for the next dilating pulse.

In this way, as in a gravity jig but with an action which is magnified by the substitution of centripetal acceleration for that of gravity, the more dense particles in the feed will penetrate the ragging and the screen 52 to enter the region 54. These particles will of course quickly move to the outer wall of the body 40, and thence downwardly due to the conical shape of this wall, to enter the cavities 64. The separated material will then migrate along the side walls of the cavities 64 to the nozzles 65, and will exit with a proportion of the supply or "hutch" water, to the heavies outlet chamber 73, while slurry containing the less dense fraction will fail to penetrate the ragging and will flow from the region 51 at its open upper end over the dam ring 43 and thence across the flange 42 to the chamber 69.

As was mentioned above, the side walls of the chambers 64 are contoured so as to present at any point along their length to the nozzle, a constant angle to a radius from the axis of rotation of the machine. The choice of this angle will be influenced by the surface finish and the frictional properties of the materials involved, but an angle of 30° has been found suitable. The angle is chosen such that no accumulation of material will occur along these side walls, but rather the cavities 64 will continually be scavenged by rotation of the apparatus at its normal operating speeds.

In the ideal case of a body of fluid of density $\rho$ rotating at angular velocity $\Omega$ about a vertical z axis with radial restraint (for example, within a rotating cylinder), with gravity acting in the direction of the negative z axis, it can be shown that in steady state conditions the pressure at a point (r, z) within the fluid is given by the expression $$p = p + \rho\left[g(H - z) - \frac{\Omega^2}{2}(R^2 - r^2)\right] \quad (1)$$

where p is the pressure (for example, atmospheric) at the free surface of the fluid passing through the point (R, H). Since at the free surface of the fluid, p =p , then the free surface is defined by the equation $$z = H - \frac{\Omega^2}{2g}(R^2 - r^2)$$

The point (R, H) in the illustrated jig will be set by the height and internal diameter of the dam ring 43.

In the ideal operation of the illustrated jig the fluid pressure at the interface of the ragging and the slurry will be constant throughout the height of the slurry, and it will be apparent from equation (1) above that this interface will lie on a paraboloid of revolution, as will the free slurry surface defined by equation (1).

In accordance with the invention, the screen 52 is shaped so that the slurry/ragging interface will lie on the necessary curve for the particular speed of rotation at which the jig is to operate, using the relationships outlined above.

In the ideal case, the shaping of the screen provides a constant thickness of ragging over the height of the screen. The curvature of the screen is therefore set as the curvature of the theoretical ragging/slurry interface, the ragging thickness being set by the quantity of ragging introduced into the machine.

Thus the theoretically correct curve for the ragging/slurry interface may be calculated, and this curve displaced radially outwardly by an amount $\delta r$ equal to the ragging thickness, to define the curve for the screen contour. Approximations to this curve can of course be arrived at by other means based o the general considerations outlined above. In fact, however, the correct curve for the screen will be a parabola which has somewhat greater curvature than that which would be derived from the above approach. This arises from the fact that incoming slurry will be the subject of hysteresis, leading to the bottom of the free slurry surface being located radially inwardly of that which would otherwise be expected. The most recently introduced particles at the bottom of the screen will therefore be subjected to less acceleration than that occuring at the screen itself. As the particles move upwardly they will move outwardly and their acceleration will increase.

It will be apparent that as the speed of jig rotation increases, the optimum screen shape will decrease in curvature, and in the limiting case of infinitely great acceleration, the optimum screen shape would be a cylinder. In practice, however, this effect will be counteracted by the hysteresis effect described, and with decreasing acceleration, as the curvature of the theoretical screen parabola increases, the hysteresis effect decreases in relative significance, so it will be found in the practice of the invention that these effects tend to cancel each other out so that the optimum parabola will be applicable over a range of jig speeds.

The depth of slurry over the jig bed is determined by the radius of the dam ring 43, and in this first embodiment the machine may be equipped with interchangeable top covers 41 having dam rings of differing diameters, to enable adjustment of the slurry depth to maximise the recovery for a given feed material.

It should be appreciated that at the very high accelerations at which a machine of this kind may be operated, the absolute extent by which the screen 52 will depart from a simple frusto-conical shape (as taught by Cross) or indeed a cylinder (as taught by Campbell) will appear to be quite small. For example, at 80 G in the machine illustrated, where the height of the screen is 63 mm the bottom of the screen will lie only 3 mm radially inwardly of the top. But in this context it must be borne in mind that the ragging thickness is of the order of 19 mm and the slurry thickness typically 5 mm. Furthermore, the concentrate particle size may be less than 100 $\mu$m, and the ragging diameter in the region of 600–1000 $\mu$m. The screen shape is therefore of great importance if the efficiency of operation of such a jig is to be maximised.

It will have been observed that the diaphragm 57 is annular, and operates only in the region radially beyond the screen 52. This ensures that the diaphragm does not operate inwardly of the notionally extended free slurry surface, that is to say within the region where, were the chambers 51 and 54 extended downwardly instead of terminating at the diaphragm and the support housing 25, no slurry would be present due to the free slurry surface being radially outwardly spaced from this region.

In this way, by the use of an annular diaphragm immediately below the level of the bottom of the screen 52, the diaphragm is located in great proximity to the body of hutch water in the region 54, thereby minimising the mass of water to be moved and maximixing the coupling between the hutch water and the diaphragm. The diaphragm can be of an area approaching that of the bottom of the volume of hutch water, minimizing the length of diaphragm stroke required for a given pulsion effect.

The efficiency of pulsion achieved in the present invention compared, for example, with that of Cross, is further enhanced by the fact that the diaphragm is coupled with fluid substantially all of which is at the high pressure which exists in the region 54 due to the centrifugal action. This pressure not only assists the descent of the diaphragm to its lowermost position under the control of the cam 59, but in fact maintains a net downwardly directed force on the cam. Thus the compaction of the ragging on the return stroke is both rapid and extensive, and there is little net flow of hutch water to the region 51. In fact, the addition of water to the tailings should not exceed about 5%.

The effect of this hydraulic behaviour is to produce both positive and negative pulses in the ragging, an effect which cannot be achieved by Cross, who does not rotate the entire body of feed, ragging and hutch water. Neither can this effect be achieved by Campbell, due to the manner of pulsion which he employs.

A machine of the type described and illustrated has been demonstrated to provide extremely efficient separation of particles according to their specific gravity, and is particularly efficient in the separation of fine particles which cannot be handled by conventional separating equipment, for example particles below 100 $\mu$m. Equipment constructed in accordance with the preferred embodiment has achieved useful separation of particles in a size range of 50% passing 20 $\mu$m and 8% passing 5 $\mu$m, achieving concentration of greater than 30 times, and useful results can be expected with gold having particle sizes down to 5 $\mu$m, and has recovery rates of 90% or better.

The speed of rotation of the outer driving shaft 23, which of course determines the acceleration applied to the particles, and the speed of rotation of the cam driving shaft 29 which determines the pulse rate of the jig, will be determined by experiment for particular materials. It will be found that operation of the apparatus at speeds which achieve accelerations in the region of 100 g at the ragging, will produce satisfactory results. The length of the stroke of the diaphragm 57 is of course controlled by the parameters of the cam surfaces 61, and the cams 59 may be replaced to vary this stroke length in order to optimise the operation of the machine for a particular feed material.

Many alternative embodiments of the present invention are possible, and it will be understood that the embodiment described and illustrated here is given by way of example only. The diaphragm 57 may be replaced by diaphragms located, for example, on the side walls of the machine, and alternative methods of actuating the diaphragm are possible, including, for example, electric or electromagnetic devices. Similarly, the disposition and arrangement of the feed and or the ragging may take forms different from those described above.

Figure 9:
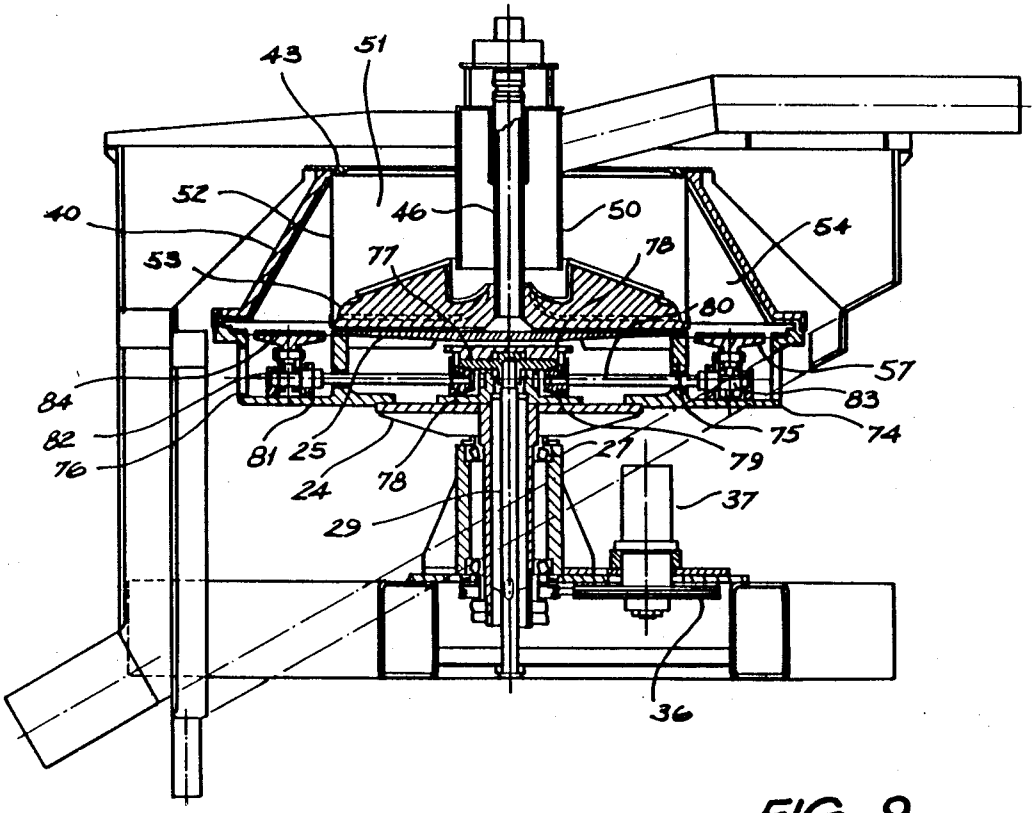
FIG. 9 shows in sectional side elevation a second embodiment of the invention.
Figure 10:
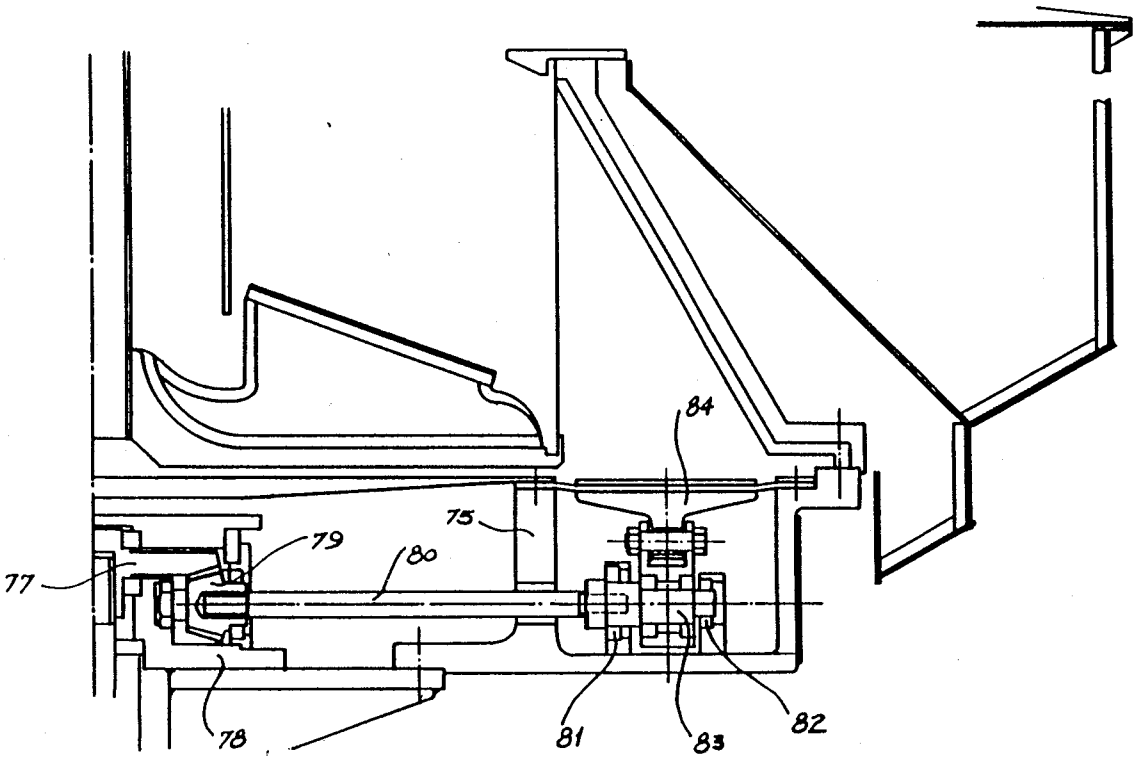
FIG. 10 is a fragmentary view showing the cam driving components of the embodiment of FIG. 9.

One such alternative embodiment is illustrated in FIGS. 9 and 10, which show an alternative and more compact mechanism for oscillating the diaphragm 57.

In this embodiment the cover 38 and pulsator body 58 are replaced by a single support member 74 mounted on the flange 24. The member 74 is provided with an inner cylindrical flange 75 which supports the support housing 25 and the inner edge of the diaphragm 57, and an outer cylindrical flange 76 which supports the outer edge of the diaphragm 57, and the body member 40.

Mounted on the upper end of the cam drive shaft 29 is a bevel gear 77, supported on bearings in a housing 78 which is in turn supported on the flange 24.

Also mounted in the housing 78 at equally circumferentially disposed positions are radially orientated pinions 79, driving radial shafts 80.

The shafts 80 pass through apertures in the inner cylindrical flange 75, and the outer end of each shaft is located in a bearing 81 mounted on the member 74 between the flanges 75 and 76. Attached to the outer end of each of the shafts 80 and supported in turn by an outer bearing 82 is a crank portion 83. The crank 83 in each case drives a diaphragm engaging member 84.

In the illustrated embodiment, six such eccentric diaphragm driving assemblies are disposed around the circumferential extent of the diaphragm 57, and it will be appreciated that the members 84 will produce vertical oscillation of the diaphragm in unison, as the cam drive shaft 29 rotates to the drive, in turn, the radial shafts 80.

The individual crank members 83 are readily accessible through apertures in the outer flange 76, and may be changed when it is desired to alter the stroke of the diaphragm 57.

Figure 11:
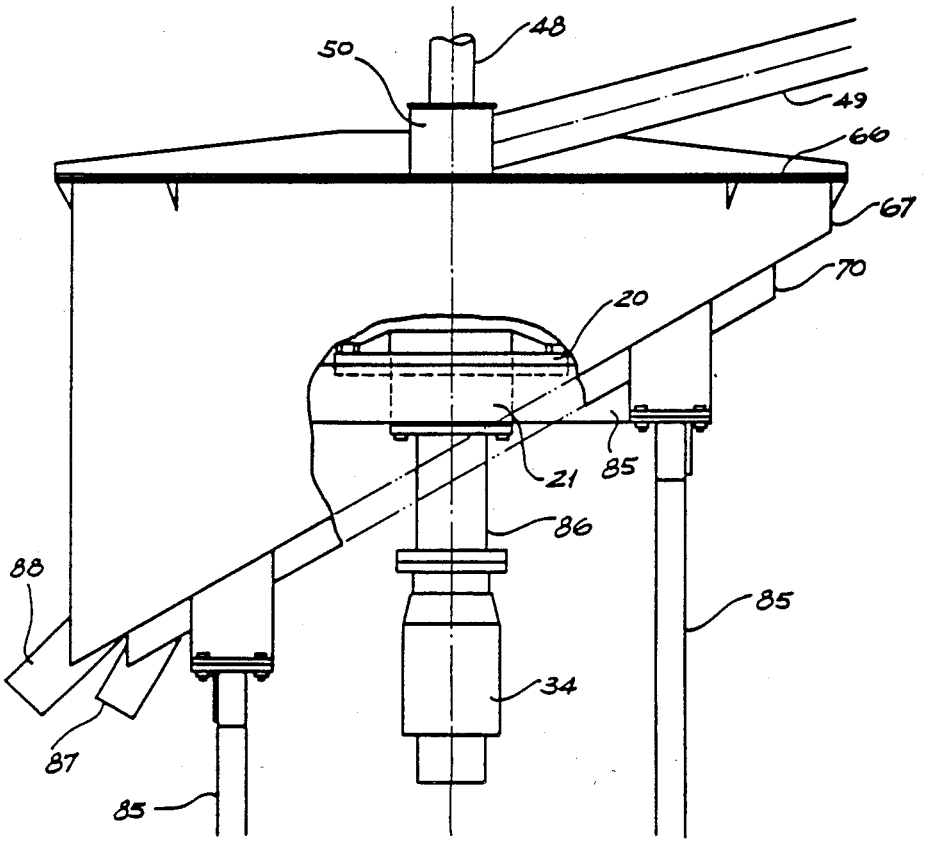
FIG. 11 is a partly sectioned side elevation of a jig according to a further embodiment of the invention, in which the diaphragm is eliminated and replaced by an air/water interface, and, FIG. 12 shows the jig of FIG. 11 in fragmentary cross-section.
Figure 12:
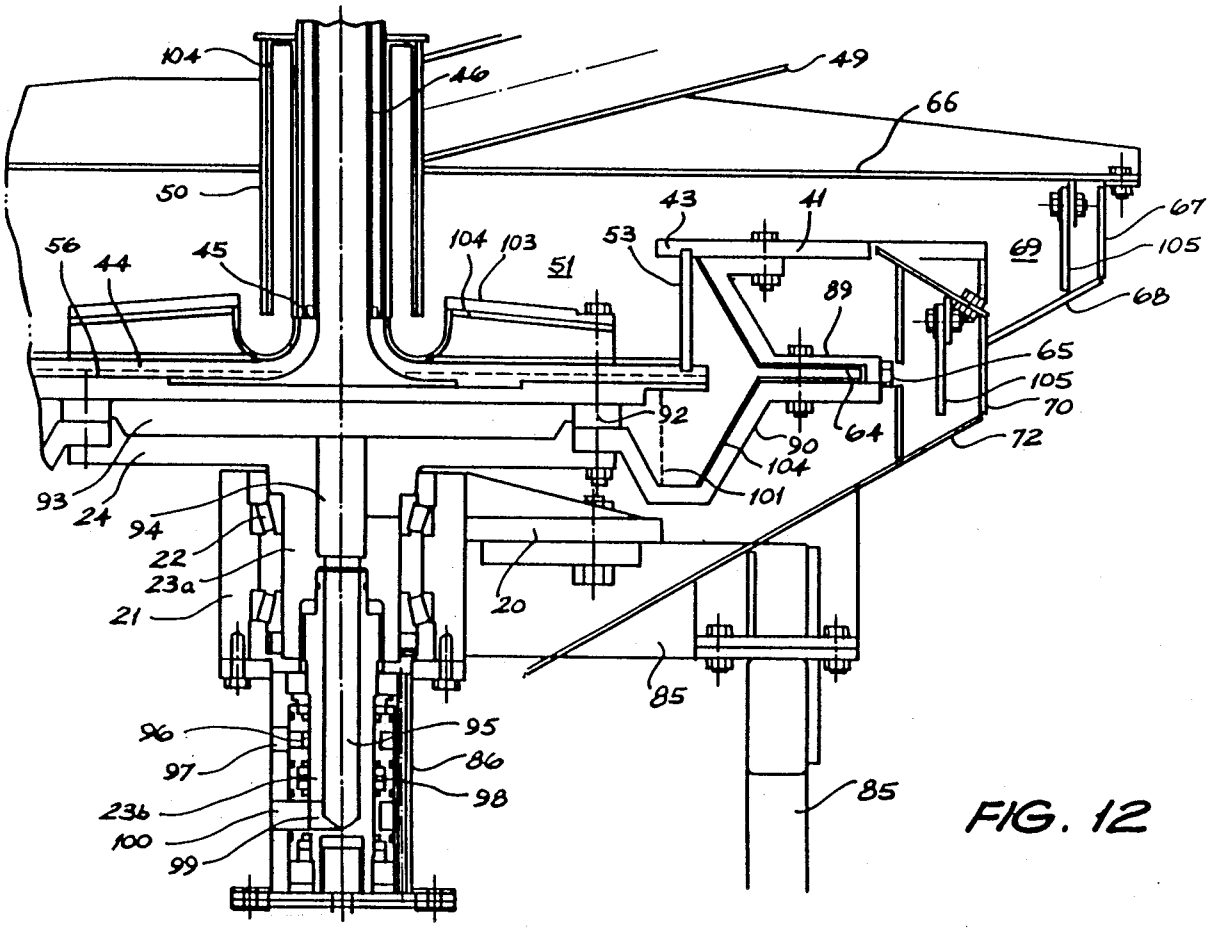

A further and different approach to the pulsion of the hutch water in a centrifugal jig of the kind to which the present invention applies is illustrated in FIGS. 11 and 12, where as before, corresponding reference numerals are used for those components which correspond to components of the previously described embodiments.

In the embodiment illustrated in FIG. 11 the diaphragm 57 as such is eliminated, allowing great simplification of the jig from a mechanical point of view. Instead of a diaphragm, an air/water interface is created in the region below the hutch region 54, and the pressure of this air is pulsed to produce the necessary pulsion of the hutch water.

As shown in FIG. 11, the jig of this embodiment comprises a frame 85 suporting the base 20, with a lower shaft housing 86 mounted below the bearing housing 21. As a separate drive is no longer required for the diaphragm, the hydraulic motor 34 is mounted directly beneath the end of the housing 86.

In FIG. 11, the heavies launder outlet is located at 87, and the light material leaves the machine at 88.

As shown in FIG. 12, the upper housing 89 which defines the hutch space is mounted on a lower housing 90 which in this embodiment is shaped substantially as a mirror image of the housing 89 forming a cavity 91 below the hutch region 54.

The cavity 91 communicates by means of passages 92 with a central chamber 93 formed between the central boss 44 and the flange 24, and this chamber in turn communicates with an axial passage 94 in the upper portion **23*a*** of the jig drive shaft.

Splined to the bottom of the upper drive shaft portion **23*a* is the lower drive shaft portion 23*b*, and this is in turn coupled with the hydraulic motor 34 (FIG. 11). An axial passage 95, closed at its lower end and open to the passage 94 is provided in the shaft portion 23B, and this passage is provided with one or more radial ports 96 communicating intermittently, as the shaft 23*b* rotates, with an air inlet passage 97 in the lower shaft housing 86. A peripheral seal member 98 is located around the shaft portion 23*b* within the housing 86**.

At the foot of the passage 95 an outlet port or ports 99 communicate intermittently with an outlet 100 in the housing 86.

The air inlet 97 is connected to a source of compressed air, so that as the jig rotates, successive pulses of air pressure are introduced into the chamber 93. The background air pressure is adjusted such that for the speed of rotation employed the air/water interface at 101 lies somewhat radially beyond the free surface of the water in the cavity 91, and the pulses of increased pressure will move this interface outwardly, creating the required pulsing effect in the ragging at the screen 52.

The depth of the cavity 91 is preferably such that the height of the air/water interface 101 is substantially that of the screen 52, and quite small excess air pressure is required to obtain the desired pulsion of the hutch water. Again in this embodiment, the location of the pulsing interface provides efficient coupling with the hutch water, and achieves rapid dilation and compaction of the ragging.

In the embodiment shown in FIGS. 11 and 12, slurry is introduced to the screen area by radial passges 102 in a distributing member 103 mounted on the boss 44, these passages, the supply jacket 50 and the boss 44 being provided with abrasive resistant polyurethane coatings 104. In the heavies outlet chamber 73 a rubber damping wall 105 is suspended opposite the nozzles 65, to reduce abrasion within this chamber.

By appropriate relative shaping and location of the air inlet 97 and the outlet 100 and the ports 96 and 99, the magnitude, frequency and shape of the air pressure pulses acting on the air/water interface may be controlled and set by experiment to those which are suited to the speed of rotation of the jig and the nature of the feed material.

The outlet 100 not only provides for the momentary escape of air during pulsion, but also enables water from the cavity 91 to drain from the jig when the jig becomes stationary.

Although air is preferred as the gaseous fluid employed in this form of the invention, where a source of other gaseous fluid under pressure is conveniently available, this may of course be employed.

In a practical jig according to the embodiment of FIGS. 11 and 12, suitable pulse rates have been found to lie in the range of 1400 pulses per minute to 2500 per minute or more. As the acceleration at the air/water interface 101 increases rapidly as air pushes water outwardly from the parabola of revolution representing the steady state free water surface, with a corresponding increase in the return pressure of the water, it is found that the correct air pressure for a given angular velocity will be established by gradually increasing the pressure as the jig is run until pulsion of the hutch water and ragging occurs.

Apart from the control which can be obtained by adjustment of the air inlet and outlet port lining and shape, the radial contour of the chamber 91 may also be modified to alter the relationship between the pressured, as the air/water interface and its radial positions, thereby modifying the pulsion waveform.

I claim:

1. A centrifugal jig comprising a container mounted for rotation about its longitudinal axis, the container comprising an axial region and a peripheral region, ragging separating said regions, means for rotating said container, means for introducing feed material to the axial region, means for supplying fluid to said peripheral region, and means for pulsating the fluid in said peripheral region while the container rotates, said pulsating means comprising interface means communicating with said peripheral region, said interface means being located substantially wholly outside the volume defined by the free surface of the feed material and the projection of that free surface to its intersection with said longitudinal axis.

2. A jig according to claim 1 wherein said interface means comprises diaphragm means.

3. A jig according to claim 2 further comprising reciprocating drive means actuating said diaphragm means.

4. A jig according to claim 2 wherein said diaphragm is located below said peripheral region and forms part of the base of said container.

5. A jig according to claim 1 wherein said interface means comprises the interface between a fluid in communication with the fluid in said peripheral region and a gaseous fluid, said interface being radially positioned by the pressure in said gaseous fluid, said pressure being pulsed thereby to cause said pulsation of the fluid in said peripheral region.

6. A jig according to claim 5 further comprising a fluid chamber below said peripheral region and communicating therewith, a gaseous fluid chamber located radially inwardly of said fluid chamber and communicating therewith, means for introducing pressurized gaseous fluid to said gaseous fluid chamber, and means pulsing the pressure in said gaseous fluid chamber.

7. A jig according to claim 6 wherein the minimum pressure of said gaseous fluid at said interface is that which is sufficient, at the speed of rotation of the container, to maintain said interface radially outwardly of the free surface of the fluid in said fluid chamber.

8. A jig according to claim 7 further comprising means for the continuous supply of fluid to said peripheral region and said fluid chamber.

9. A jig according to claim 1 wherein said ragging is restrained for rotation about said axis by a screen, said screen being substantially in the shape of a paraboloid of revolution the axis of which coincides with said longitudinal axis, said screen being so contoured that the common boundary between said ragging and said feed material lies on a surface of revolution of substantially constant pressure.

10. A centrifugal jig comprising a container mounted for rotation about a vertical longitudinal axis, the container comprising an axial region and a peripheral region, ragging separating said regions, means or rotating said container, screen means, means for introducing feed material to the axial region, means for supplying fluid to said peripheral region, and means for pulsating the fluid in said peripheral region while the container rotates, said ragging being radially constrained by said screen means, said screen means lying substantially on a paraboloid of revolution the axis of which coincides with said longitudinal axis, and said screen means being shaped such that the common boundary between said ragging and said feed material lies on a surface of revolution of substantially constant pressure.

11. A jig according to claim 10, further comprising flange means extending horizontally inwardly from the upper edge of said screen, the inner edge of said flange means being concentric with said screen.

12. A jig according to claim 11 further comprising tailings launder means communicating with the region above and radially outward of said flange.

13. A jig according to claim 10 comprising heavies launder means located outwardly of and communicating with said peripheral region.

14. A centrifugal jig comprising a container mounted for rotation about a vertical longitudinal axis, the container comprising an axial region and a peripheral region, ragging separating said regions, screen means, said ragging being radially constrained by said screen means, means for introducing feed material which includes concentrate to the axial region, means for introducing fluid to the peripheral region, means for pulsating fluid in said peripheral region while the container rotates, and heavies launder means located outwardly of said peripheral region, wherein the concentrate passing said ragging and said screen passes to said heavies launder through cavities communicating with said peripheral region, said cavities comprising side walls converging to a cavity outlet, said side walls presenting, along their length to said outlet, a constant angle to radii from said longitudinal axis.

15. A jig according to claim 14 wherein said angle is chosen in relation to the coefficients of friction of the walls and of the concentrate such that no accumulation of material occurs along said walls.

* * * * *